US005385101A

United States Patent [19]

Corzine et al.

[11] Patent Number: 5,385,101

[45] Date of Patent: Jan. 31, 1995

[54] HUNTING BULLET WITH REINFORCED CORE

[75] Inventors: Alan J. Corzine, Marine; Gerald E. Eberhart, Bethalto, both of Ill.

[73] Assignee: Olin Corporation, East Alton, Ill.

[21] Appl. No.: 143,712

[22] Filed: Nov. 1, 1993

Related U.S. Application Data

[63] Continuation-in-part of Ser. No. 56,146, Apr. 30, 1993.

[51] Int. Cl.[6] ..... F42B 12/34

[52] U.S. Cl. ..... 102/509; 102/517

[58] Field of Search ..... 102/501, 507, 508, 509, 102/510, 517, 518

[56] References Cited

U.S. PATENT DOCUMENTS

| | | | |
|---|---|---|---|
| 623,707 | 4/1899 | Dittmar | 102/518 |
| 1,380,773 | 6/1921 | Clay | 102/518 |
| 1,432,669 | 10/1922 | Clay | 102/518 |
| 1,468,113 | 9/1923 | Johnsen | 102/507 |
| 1,512,026 | 10/1924 | Holden et al. | 102/509 |
| 2,327,950 | 8/1943 | Whipple | 102/507 |
| 2,682,224 | 6/1954 | Braverman | 102/507 |
| 2,792,618 | 5/1957 | Walker | 102/507 |
| 2,932,253 | 4/1960 | Auxier | 102/507 |
| 2,958,287 | 11/1960 | Auxier | 102/507 |
| 3,003,420 | 10/1961 | Nosler | 102/508 |
| 3,157,137 | 11/1964 | Burns, Jr. | 102/509 |
| 3,349,711 | 10/1967 | Darigo et al. | 102/509 |
| 4,044,685 | 8/1977 | Avcin | 102/508 |
| 4,550,662 | 11/1985 | Burczynski | 102/509 |
| 4,610,061 | 9/1986 | Halverson | 102/509 |
| 4,655,140 | 4/1987 | Schirneker | 102/508 |
| 5,009,166 | 4/1991 | Bilsbury et al. | 102/517 |
| 5,101,732 | 4/1992 | Schluckebier | 102/509 |
| 5,127,332 | 7/1992 | Corzine et al. | 102/509 |
| 5,208,424 | 5/1993 | Schluckebier et al. | 102/509 |

*Primary Examiner*—David Brown
*Attorney, Agent, or Firm*—Gregory S. Rosenblatt

[57] ABSTRACT

A controlled expanding small caliber bullet is disclosed which comprises a partition-type bullet, a rear cavity filled with a dense core and a high strength insert between the core and the body in the forward portion of the rear cavity.

29 Claims, 3 Drawing Sheets

HUNTING BULLET WITH REINFORCED CORE

This application is a continuation-in-part of U.S. patent application Ser. No. 08/056,146 filed Apr. 30, 1993.

BACKGROUND OF THE INVENTION

1. Field of Invention

This invention relates generally to hunting bullets and more particularly to hollow point bullets.

2. Description of the Related Art

Hunting bullets are generally small caliber, i.e. less than 0.50 caliber. They generally have a hollow point or soft metal nose portion to increase expansion of the bullet upon impact with animal tissue in order to achieve increased energy adsorption within the target animal's body. Lead hollow point bullets have a significant drawback for use in hunting applications. They tend to upset and expand greatly within a short penetration distance and are thus not suitable for deep penetration. This is particularly true where the bullet hits a bone during passage into the animal. Hunters often aim for the shoulder area of the target animal in order to minimize the chance of the animal escaping after it has been shot and because the vital organs of the animal are in the same general area of the animal as the shoulder.

Expansion of the bullet is desirable to slow the bullet and transfer more energy to the target during passage through soft animal tissue. If the bullet does not expand significantly and does not hit a bone or vital organ, it may pass through the animal without killing the animal or stopping the animal. For the bullet to successfully pass through animal bone and still do damage to vital organs, it is necessary that the bullet have density, sufficient structural integrity and retained weight.

One hunting bullet which addresses some of the above needs is that disclosed in our prior U.S. Pat. No. 5,127,332, which is incorporated by reference in its entirety herein. The patent discloses a unitary metal body of generally H shaped longitudinal cross section with an empty hollow point in front and a rear cavity filled with a dense material such as lead. The rear cavity was closed by a disk to seal the lead from the environment. This bullet has several advantages and disadvantage. One advantage is that it has good weight retention due to the lead being confined to the rear cavity so the bullet does not lose a significant part of its weight if the petals in the front break off during penetrations of the target, since the front hollow point portion of the bullet is relatively light in comparison to the dense solid rear portion of the bullet. Another advantage is that the forward part of the side walls of the rear cavity of the bullet tend to bulge due to the forward inertia and kinetic energy of the heavy lead core during the rapid deceleration upon impact. The bulge helps in making a larger diameter wound channel, but reduces the depth of penetration. The disadvantage of this bullet is that it has been found to break apart with failure initiated at the bulge when it hits heavy bones at near muzzle velocity.

An improvement is needed in order to achieve the advantages of the bullet of our prior U.S. Pat. No. 5,127,332 without the disadvantage.

SUMMARY OF THE INVENTION

Brief Technical Description

The problem is solved by the bullet of the present invention described and claimed below in which a high tensile strength thin liner is placed in the forward portion of the rear cavity to prevent side wall rupture. In the preferred form of the invention, the partition has enough thickness to prevent the rear core from punching through the partition upon rapid deceleration, and it was found that the insert should have a length sufficient to protect against side wall puncture by petals formed from the rearward petaling of the hollow point.

BRIEF DESCRIPTION OF THE DRAWINGS

The invention will be better understood by reference to the enclosed drawing in which.

DETAILED DESCRIPTION OF THE INVENTION

Technical Basis for the Invention

The invention stems from a thorough understanding of the manner in which hunting bullets are made and used. In particular, the fact of occasional lack of bullet penetration had to be recognized. Next, the lack of penetration had to be attributed to bullet break up. Then the reason for break up of the bullet of our prior U.S. Pat. No. 5,127,332 had to be recognized and a solution determined that was economical to manufacture but yet retained the advantages of the bullet (increased density and good penetration in soft tissue and reasonable chamber pressures on firing). The metal in the bullet body is stronger than bone, so it was determined that the bullet itself must be strengthened in the area of failure but where that area was not obvious. We recognized that the deceleration of the bullet upon bone impact was so sudden that the rear core was rupturing the sidewalls of the cavity. However, we found that thickening the sidewalls did not reduce bulging and/or petal piercing. During one test, to our great surprise, we found a hollow point petal "speared" right through the front part side wall in the location shown in FIG. 4 at reference number 56. We tried just putting a deflanged 209 primer cup into the rear cavity and amazingly the bullet resisted failure but retained nearly 90% of its weight. Repeated testing demonstrated that with this seemingly simple modification, the bullet was now surprisingly and unexpectedly achieving the desired superior penetration through either bone or soft tissue. This bullet is the soon to be produced Winchester® Black Talon® centerfire rifle cartridge.

Preferred Embodiments

Figure 1:
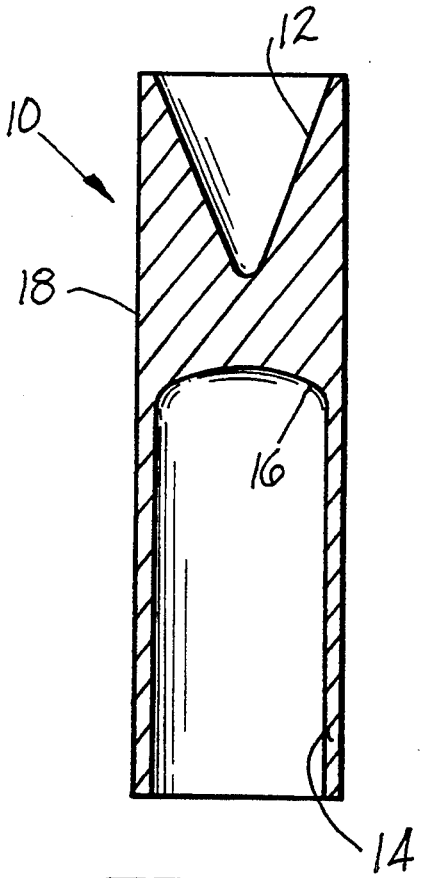
FIG. 1 is an axial cross sectional view of a preferred bullet body preform for the bullet of FIG. 3.
Figure 2:
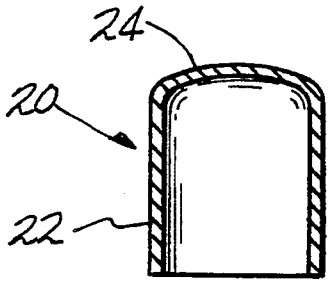
FIG. 2 is an axial cross sectional view of a preferred insert for the bullet of FIG. 3.

A controlled expanding or mushrooming small caliber bullet constructed in accordance with the present invention is illustrated in FIG. 1–4. Referring first to FIG. 1, a cylindrical tubular bullet body preform 10 is shown with a forwardly open, rearwardly tapered front recess 12 and a rearwardly open cylindrical rear recess or cavity 14 with a generally rounded transverse wall or "partition" 16. Preform 10 is preferably made of a copper alloy. Recess 12, cavity 14 and partition 16 are tandemly arranged along a central axis of the tubular preform. FIG. 2 shows a cup-shaped tubular insert 20 having a cylindrical side wall 22 and a concave base 24. The outer diameter of insert 20 is slightly less than the inner diameter of cavity 14 of preform 10 and base 24 conforms to the rear surface of partition 16.

Figure 3:
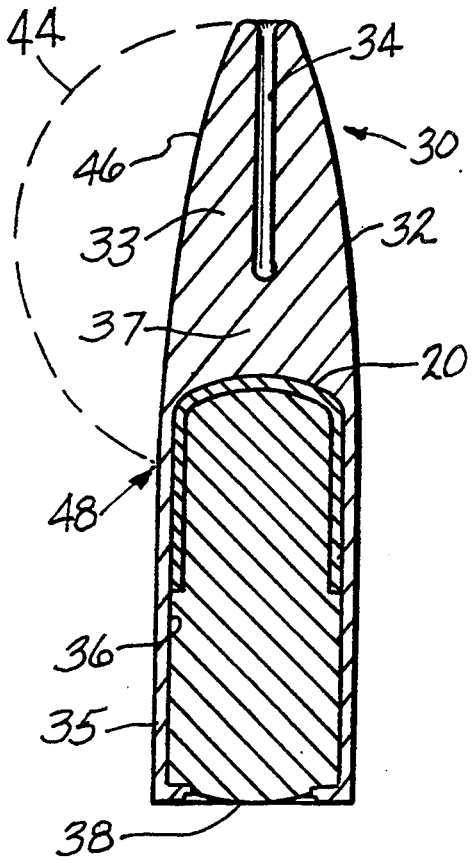
FIG. 3 is an axial cross sectional view of a bullet constructed in accordance with the present invention.

FIG. 3 shows the preferred bullet of the invention in the configuration it would generally have for a .300 Winchester ® Magnum 180 grain centerfire rifle bullet. Minor dimensional modifications would be made for other calibers of bullets. Bullet 30 has a unitary metal body 32 of generally H-shaped axial cross section with a front recess 34, a rear cavity 36 and a partition therebetween. "Partition" merely refers to the material which lies between a rear end or "bottom" of recess 34 and a front end or "bottom" of rear cavity 36. Bullet 30 is formed by inserting insert 20 fully into rear cavity 14 of preform 10 and then inserting a lead core 38 into rear cavity 36 and into insert 20 (or inserting the core into the insert and then inserting the combined core and insert into rear cavity 36) and then deforming the combined preform, insert and core to form bullet 30.

Preferred Mode of Operation

Figure 4:
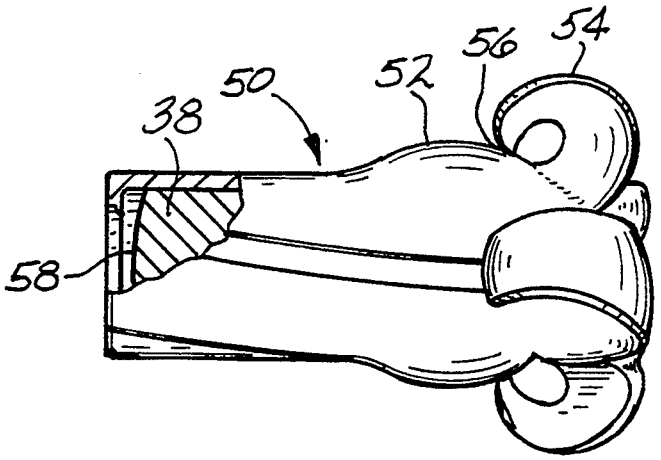
FIG. 4 is a side view in partial cross section of the bullet of FIG. 3 after impact with soft animal tissue.

In operation, the bullet is assembled as noted above and then loaded into a primed cartridge case along with the desired amount of propellant to produce a loaded ammunition round such as a "Winchester Black Talon Fail Safe Supreme" brand .300 Winchester Magnum caliber centerfire rifle cartridge. The cartridge is then loaded into the appropriate rifle and fired at a desired target such as a deer or elk. If the bullet passes through soft animal tissue, the petals 46 tend to fold back along a path such as 44 until they come into contact at some point 48 on the outer wall of the bullet surrounding rear cavity 36. The configuration of the "upset" bullet after a typical impact with soft animal tissue (or ordnance gelatin) is depicted in FIG. 4, although the petals would normally lie at an angle relative to the bullet axis due to rotational forces from the deceleration of the spinning bullet upon such impact. Upset bullet 50 has a bulge 52, upset petals 54 with tips 56 and the core 38 has moved forwardly to line 58 due to the forward momentum of the dense core and the rearward external drag on the body 32. Referring to FIG. 3 and FIG. 4, bulge 52 is a potential source of bullet failure which is prevented due to the higher tensile strength of insert 20 than body 32. The softness and engravability of a copper alloy body is preferred to prevent excess chamber pressures that would be expected if the body was made of steel or solid copper. The petal tips 56 can also be a source of bullet failure if the petals lie in the configuration illustrated in FIG. 4 and if the side wall of the body and insert are of insufficient strength. The failure in such a situation would be due to the petals spearing through the body and allowing the lead core to extrude out. Insert 20 serves to greatly reduce the likelihood of that occurring because the insert is stronger than the petals 54, so the petals tend to deform further, or break off, rather than penetrate the insert. SAE 1008 steel has been found to be a suitable material for insert 42. Because large axial forces can be put on the front of bullet 50 if it hits a bone or other hard object, the insert is desired to prevent failure of the wall of cavity 36. The petaling of the front portion of the bullet 30 to form a much larger diameter front to the bullet is needed to slow the bullet down if it does not hit a bone or other hard object in the target. The deceleration in soft animal tissue is due to increased drag due to the greatly increased diameter. The petals slow down the bullet the desired amount in soft animal tissue to achieve the desired depth of penetration. The desired depth of penetration is usually the full thickness of the animal and just a little more, so that the bullet will exit the far side with only minimal velocity (for safety reasons and since any kinetic energy remaining on exit is not transferred to the animal and is thus normally wasted).

Figure 5:
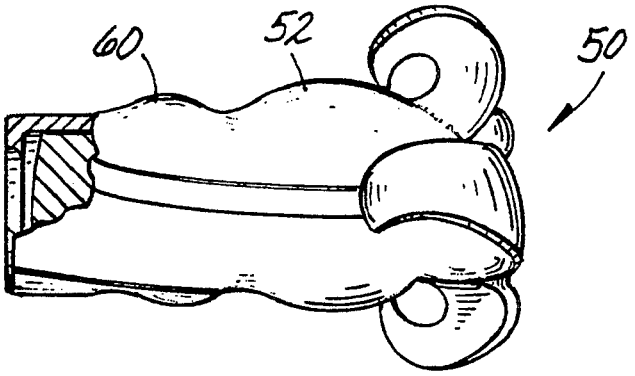
FIG. 5 is a side view in partial cross section of the bullet of FIG. 3 after impact with a hard target.

FIG. 5 shows in cross sectional view the bullet 50 of FIG. 3 after striking a hard target, such as a bone. The bullet 50 develops a secondary bulge 60 rearward of the primary bulge 52. The primary bulge 52 and secondary bulge 60 are preferably minimized or prevented because bulges are a likely spot of jacket failure and they reduce penetration. While the insert 20 of FIG. 2 is effective in minimizing bulge formation, primarily when soft tissue is struck, the embodiments illustrated in FIGS. 6–9 are more effective if a hard target is struck.

Figure 6:
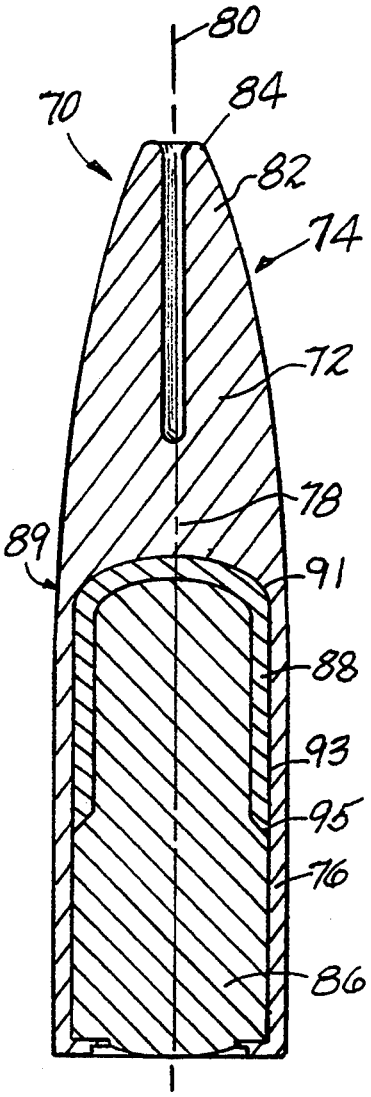
FIG. 6 is an axial cross sectional view a bullet constructed in accordance with the present invention having an increased thickness insert.

FIG. 6 shows in axial cross sectional view a controlled expansion bullet 70 in accordance with an embodiment of the invention. As with the preceding embodiments, the bullet 70 has a unitary metal body 72 of generally "H" shaped axial cross section having an ogival nose portion 74, a generally cylindrical heel portion 76 behind the nose portion 74 and an integral partition 78 between the nose portion 74 and heel portion 76. A central axis 80 passes through the nose portion 74, heel portion 76 and partition 78 symmetrically dividing the components. The nose portion 74 has an empty hollow point 82 formed by a rearwardly extending forwardly open central blind bore 84. The heel portion 76 has a rearwardly open cavity 86. This cavity 86 is filled with a dense core 38 such as lead or a lead based alloy. Other dense materials, which may be lead free, are also suitable.

One or more tubular metal inserts 88 formed from a material having a higher tensile strength than the metal body 72 are also located in the rearwardly open cavity 86. These tubular inserts are arranged concentrically about the central axis 80 and have the same symmetry as the other bullet components. Preferably, the tubular insert 88 is closed at one end and open at the opposing end with the closed end disposed between the dense core 38 and the partition 78.

The bullet 70 resists bulging through the addition of the inserts 88. The combined thickness of the inserts, or thickness of a single insert 88 as in the embodiment of FIG. 6 is on the order of from about 0.13 to about 2.54 millimeters (0.005–0.100 inch) and more preferably from about 0.38 to about 2.03 mm (0.015–0.080 inch).

The body 72 of bullet 70 is manufactured from a copper alloy such as CDA 210 (Copper Development Association designation for an alloy containing, by weight, 95% copper and 5% zinc) as well as other copper based copper/zinc alloys. The insert 88 is formed from any material having a tensile strength greater than that of the copper body 72. Typically, the insert 88 is metallic and preferably, formed from steel such as that designated by the S.A.E. (Society of Automotive Engineers) as 1008 steel (nominal composition by weight 0.10% carbon, 0.30% silicon, 0.50% manganese, 0.070% phosphorous, 0.060% sulphur and the balance iron).

The steel insert 88 provides many advantages over a conventional bullet lacking the insert. The steel insert 88 provides additional strength to reduce bulging directly behind the partition 78. Added structural backing is provided in the heel portion 76, where the petals formed from the nose portion 74 contact the body 72 when they fold rearward after striking a target. Absent the steel inserts 88, the heel portion 76 is subject to puncture by the folding petals which could cause a heel rupture and leakage of the dense core 38, typically lead. The steel insert 88 is located near the center of gravity of the bullet 70 and does not significantly affect the aerodynamic properties of the bullet.

Unlike a solid copper projectile, the bullets of the invention do not have a detrimental increase in gun barrel chamber pressure when the steel insert is added. The dense core 38 is malleable and cushions the heel portion 76 of the bullet 70 reducing the engraving forces, thereby avoiding or limiting a pressure increase.

The bulging resistance of the bullet 70 is further enhanced by increasing the thickness of the copper body 72 in the region 89 immediately behind the partition 78. The additional thickness provides additional strength to resist bulging and puncture. Additionally, an increased volume of ductile copper, as compared to the ductility of the steel insert 88 provides barrel cushioning to reduce engraving forces keeping ignition pressure under control. The thickness of the body 72 in the region 89 immediately behind the partition 78 is from about 0.25 to about 2.03 mm (0.010–0.080 inch) and, more preferably, from about 0.38 to about 1.27 mm (0.015–0.050 inch).

The steel insert 88 is preferably formed with large radius 91. The large radius 91 allows for extra ductile copper at the interface of the insert 88 and heel portion 76 resulting in better upset performance when a hard target is struck. If the radius is too small, a stress point is created which can lead to jacket failure even with the steel insert.

The extra copper is beneficial because erosion by high velocity target particles is excessive in this area. The radius 91 is that effective to prevent formation of a stress point when the bullet obliquely strikes a target, typically, the radius is from about 0.51 to about 3.81 mm (0.020–0.150 inch). More preferably, the radius 91 is from about 1.00 to about 2.54 mm (0.040–0.100 inch).

While the insert 88 of FIG. 6 is effective to prevent piercing of the jacket, some bulging may still occur because a single steel insert 88 effective to prevent piercing is of a thickness that the rigidity is such that the insert does not conform to the copper body 72 during upset. As a result, dense core material, such as lead, in the bullet heel can extrude into the interface 93 between the insert 88 and the body 72. The extruded lead can form a bulge in the heel portion 76 which may lead to rupture of the body and lead leakage, thereby defeating a purpose of the steel insert.

One way to avoid lead leakage is to taper the open end 95 of the steel insert so that the thickness at the open end is less than the thickness at the closed end. The closed end of the steel insert 88 preferably has a thickness of from about 0.25 to about 2.54 mm (0.010–0.100 inch) and the open end 86 thickness is from about 0.13 to about 1.52 mm (0.005–0.060 inch), and more preferably from about 0.13 to about 0.64 mm (0.005–0.025 inch).

Tapering of the single steel insert 88 so that it is thinner at the open end of the insert solves the obturation of the dense core problem. However, a thick single insert 88 is rigid. When the bullet 70 strikes a hard target on an oblique angle, the momentum of the steel insert concentrates sufficient force on an edge of the body that erosion through the partition 78 can occur, causing a bullet failure.

Figure 7:
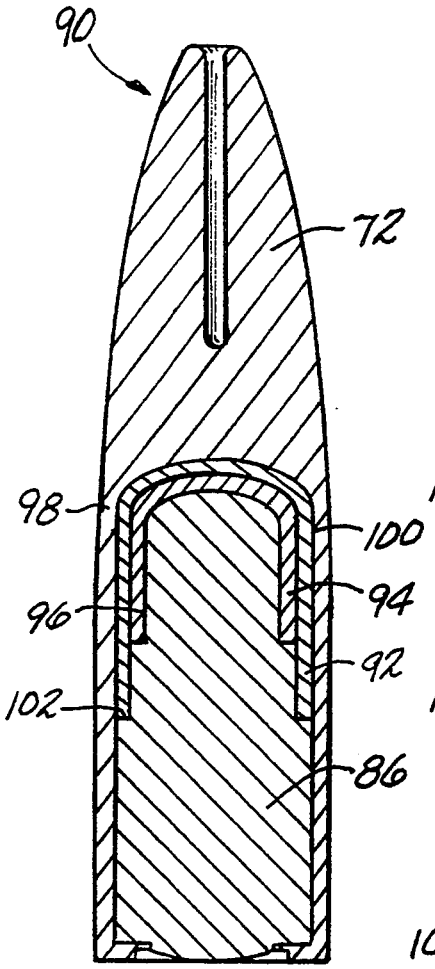
FIG. 7 is an axial cross sectional view of another bullet constructed in accordance with the present invention having a plurality of inserts.
Figure 8:
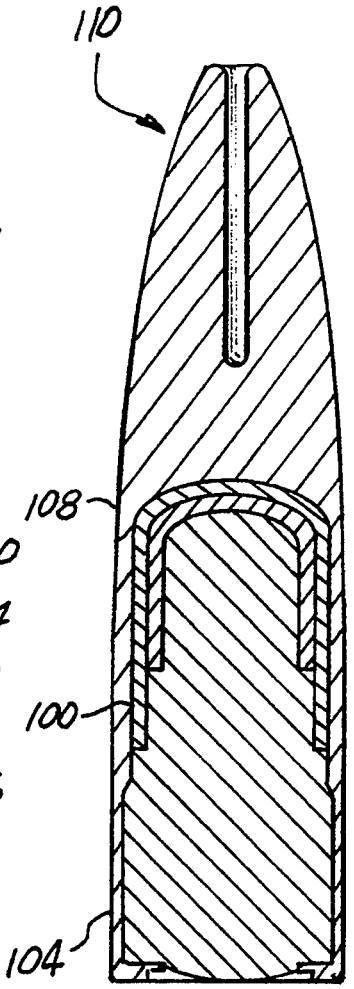
FIG. 8 is an axial cross sectional view of yet another bullet constructed in accordance with the present invention having a tapered jacket.

FIG. 7 shows in axial cross sectional view a bullet 90 which utilizes a plurality of steel inserts. While any number of steel inserts may be utilized, two are sufficient to provide the bullet with increased flexibility. The first insert 92 is adjacent the metal body 72. The second, and each additional (if present), insert 94 is disposed between the first insert 92 and the dense core 38. The first insert 92 and second insert 94 may be formed from any material having a tensile strength greater than that of copper or the copper alloy used to form body 72. As discussed above, a metallic material such as SAE 1008 steel is preferred.

The first 92 and second 94 inserts may be the same thickness or of different thicknesses. If the thicknesses are different, it is preferred that the second insert 94, the innermore of the inserts, is the thicker. The sum of the thicknesses of the plurality of inserts is about equal to the thickness of the single insert 88 of FIG. 6.

The first tubular insert 92 may have tapered legs 102 to minimize lead obturation as discussed above. The thickness of the open end is then less than the thickness of the closed end of the insert. Preferably, the thickness of the open end is from about equal to about 75% the thickness of the closed end.

The inserts may be of equal length, but improved performance through greater flexibility is obtained when the length of the first insert 92 is greater than the length of the second insert 94. With multiple inserts, the length increases as the inserts are disposed progressively closer to the metal body. The length of the legs 96 of the second insert 94 is that sufficient to extend beneath the region 98 in which a primary bulge (reference numeral 50 in FIG. 5) forms. This is generally on the order of from about 1.27 to about 6.35 mm (0.050–0.250 inch) from the radius 100 of the first insert 92. The length of the legs 102 of the first insert is that effective to inhibit development of a secondary bulge. This length is from about 1 to about 2.5 times that of the length of the legs 96 of the second insert 94 and preferably from about 1.2 to about 2.0 times the length of the legs 96. The length is usually on the order of from about 2.54 to about 12.7 mm (0.1000–0.500 inch) and preferably from about 5.1 to about 10.2 mm (0.200–0.400 inch) from the radius 100.

The first insert 92 and second insert 94 act independently of one another as the bullet 90 bends in response to striking a hard target. The entire momentum of the steel insert is not delivered to a single point as with the single insert of the previous embodiment. As a result, the bullet 90 is characterized by increased flexibility and a reduced tendency to pierce the jacket 72.

The second insert 94 has shorter legs 96 than the first insert 92 to provide additional bending flexibility and to allow for improved obturation to prevent lead leakage between the combination of inserts and the copper jacket during upset following impact with a target.

The addition of the steel inserts leads to an increase in bullet length. Reducing the thickness of the wall of the metal body 104 rearward of the first tubular insert 106 as illustrated in axial cross sectional view in FIG. 8, minimizes the bullet length increase. The reduced body 104 thickness also provides better jacket obturation in the gun barrel and increases the ease of bullet assembly. Preferably, the thickness of the jacket in the region rearward of the outermost insert 106 is from about 60% to about 90% the thickness of the jacket 108 in the region adjacent the legs of the inserts. Preferably, the thickness reduction is from about 10% to about 40% the thickness of the jacket region adjacent the inserts 108.

Figure 9:
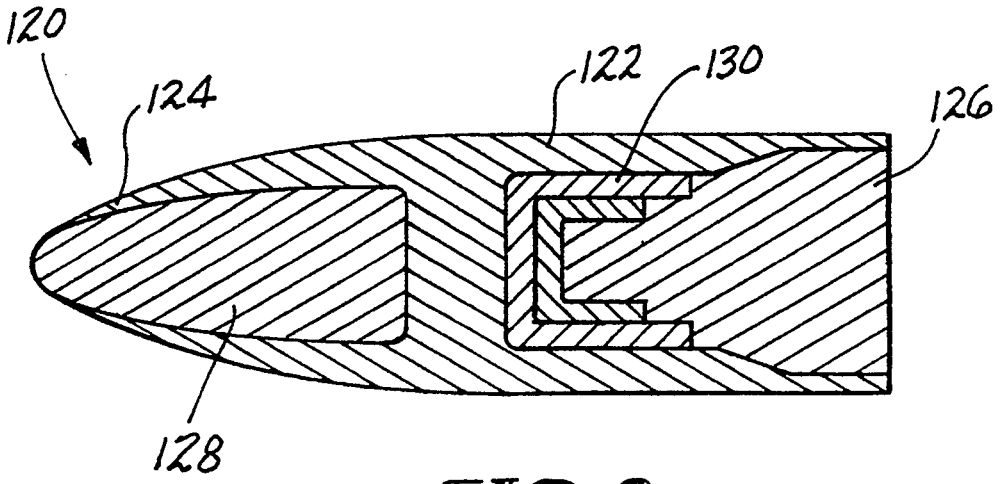
FIG. 9 shows in axial cross sectional view a copper/-lead partition bullet utilizing the inserts of the invention.

In addition to the copper nose bullets of FIGS. 3, 6, 7, and 8, the inserts are applicable to other types of bullets such as a partition bullet 120 illustrated in axial cross sectional view in FIG. 9. In the bullet 120, rupture of the heel 122 is primarily from lead obturation rather than petal piercing because the jacket portion 124 is thinner and less rigid. For this reason, the partition bullet 120 upsets better at lower velocities and is useful in low velocity cartridges such as the 30-30 Winchester Cartridge.

The metal body 124 is copper or a suitable copper alloy such as CDA 210. The rearward portion 126 and frontward portion 128 are independently filled with a dense ductile material such as lead or a lead alloy. The inserts 130 may be of any of the configurations described above.

While the invention has been described in terms of hollow-point bullets, it is equally applicable to other types of bullets as well. Any of the bullets described above may additionally include a closure disc if appropriate.

The advantages of the present invention will become more apparent from the example which follows. The example is exemplary and not intended to limit the scope of the invention.

EXAMPLE

A variety of bullets were fired at different targets to determine the upset characteristics. The bullets were of a standard size: 35.56 mm (1.4 inch) in length, 7.82 mm (0.308 inch) in diameter and 9.72 grams (180 grains) in weight and fired from a .300 Winchester magnum cartridge. As shown from Table 1, the double inserts of the invention provided the best resistance to both bulging and piercing of the jacket by the petals after striking a variety of targets at a 45.7 meter (50 yard) impact velocity.

TABLE 1

| Sample Type | Target | Results |
|---|---|---|
| No insert | Gelatin | Heel bulge |
| | Bone/gelatin | 100% fragmentation |
| Single insert | Gelatin | Reduced heel bulge |
| | Bone/gelatin | Heel bulge, 20–50% heel rupture |
| Double insert | Gelatin | Almost no bulge |
| | Bone/gelatin | Slight bulge, 0% heel rupture |

While the invention has been described above and below with references to preferred embodiments and specific examples, it is apparent that many changes, modifications and variations in the materials, arrangements of parts and steps can be made without departing from the inventive concept disclosed herein.

Accordingly, the spirit and broad scope of the appended claims is intended to embrace all such changes, modifications and variations that may occur to one of skill in the art upon a reading of the disclosure

What is claimed is:

1. A controlled expansion bullet, comprising:

a unitary metal body of generally "H" shaped axial cross section having an ogival nose portion, a generally cylindrical heel portion behind said nose portion and an integral partition therebetween along a central axis therethrough, said nose portion having an empty hollow point formed by a rearwardly extending forwardly open central blind bore and said heel portion having a rearwardly open cavity therein;

a dense core filling said heel portion cavity; and a plurality of tubular metal inserts of higher tensile strength than said metal body located in said rear cavity.

2. The bullet of claim 1 wherein said plurality of tubular inserts are concentric about said central axis and closed at one end.

3. The bullet of claim 2 wherein said closed ends are disposed between said dense core and said integral partition.

4. The bullet of claim 3 wherein a first tubular insert is adjacent said metal body and a second tubular insert is disposed between said first tubular insert and said dense core.

5. The bullet of claim 4 wherein the length of said first tubular insert is greater than the length of said second tubular insert.

6. The bullet of claim 5 wherein the length of said first tubular insert is that effective to prevent the formation of a secondary bulge and the length of said first tubular insert is that effective to prevent the formation of a primary bulge when said bullet strikes a hard target.

7. The bullet of claim 5 wherein the open end of said first tubular insert has a thickness less than the thickness of said closed end.

8. The bullet of claim 7 wherein the thickness of said open end is from about equal to about 75% less than the thickness of said closed end.

9. The bullet of claim 5 wherein the thickness of the wall of said metal body rearward of said first tubular insert is less than the thickness of said wall adjacent the closed end of said first tubular insert.

10. The bullet of claim 5 wherein the radius of curvature of said closed end of said first tubular insert is effective to prevent the formation of a stress point when said bullet obliquely strikes a target.

11. The bullet of claim 10 wherein said radius of curvature is from about 0.51 mm to about 3.8 mm.

12. A controlled expansion bullet, comprising:

a unitary metal body of generally "H" shaped axial cross section having an ogival nose portion, a generally cylindrical heel portion behind said nose portion and an integral partition therebetween along a central axis therethrough, said nose portion having an empty hollow point formed by a rearwardly extending forwardly open central blind bore and said heel portion having a rearwardly open cavity therein;

a dense core filling said heel portion cavity; and a tubular metal insert of higher tensile strength than said metal body located in said rear cavity, said tubular metal insert having a closed end and an open end, the thickness of said open end being less than the thickness of said closed end.

13. The bullet of claim 12 wherein said tubular insert is concentric about said central axis and said closed end is disposed between said dense core and said integral partition.

14. The bullet of claim 13 wherein the thickness of the wall of said metal body rearward of said tubular insert is less than the thickness of said wall adjacent the closed end of said tubular insert.

15. The bullet of claim 13 wherein the radius of curvature of said closed end of said tubular insert is effective to prevent the formation of a stress point when said bullet obliquely strikes a target.

16. A controlled expansion bullet, comprising:

a unitary metal body of generally "H" shaped axial cross section having an ogival nose portion, a generally cylindrical heel portion behind said nose portion and an integral partition therebetween along a central axis therethrough, said nose portion having an empty hollow point formed by a rearwardly extending forwardly open central blind bore and said heel portion having a rearwardly open cavity therein, a dense core filling said heel portion cavity; and a tubular metal insert of higher tensile strength than said metal body located in said rear cavity, said tubular metal insert having a closed end and an open end, the thickness of the wall of said metal body rearward of said tubular insert being less than the thickness of said wall adjacent the closed end of said tubular insert.

17. A bullet, comprising:

a unitary metal body having an ogival nose portion, a generally cylindrical heel portion behind said nose portion and an integral partition therebetween along a central axis therethrough, said heel portion having a rearwardly open cavity therein;

a dense core filling said heel portion cavity; and a plurality of tubular metal inserts of higher tensile strength than said metal body located in said rear cavity.

18. The bullet of claim 17 wherein said plurality of tubular inserts are concentric about said central axis and closed at one end, said closed ends being disposed between said dense core and said integral partition.

19. The bullet of claim 18 wherein a first tubular insert is adjacent said metal body and a second tubular insert is disposed between said first tubular insert and said dense core, the length of said first tubular insert being greater than the length of said second tubular insert.

20. The bullet of claim 19 wherein the length of said first tubular insert is that effective to prevent the formation of a secondary bulge and the length of said first tubular insert is that effective to prevent the formation of a primary bulge when said bullet strikes a hard target.

21. The bullet of claim 19 wherein the open end of said first tubular insert has a thickness less than the thickness of said closed end.

22. The bullet of claim 19 wherein the thickness of the wall of said metal body rearward of said first tubular insert is less than the thickness of said wall adjacent the closed end of said first tubular insert.

23. The bullet of claim 19 wherein the radius of curvature of said closed end of said first tubular insert is effective to prevent the formation of a stress point when said bullet obliquely strikes a target.

24. The bullet of claim 19 wherein said nose portion has a rearwardly extending forwardly open central blind bore filled with a dense material.

25. A bullet, comprising:

a unitary metal body having an ogival nose portion, a generally cylindrical heel portion behind said nose portion and an integral partition therebetween along a central axis therethrough, said heel portion having a rearwardly open cavity therein;

a dense core filling said heel portion cavity; and a tubular metal insert of higher tensile strength than said metal body located in said rear cavity, said tubular metal insert having a closed end and an open end, the thickness of said open end being less than the thickness of said closed end.

26. The bullet of claim 25 wherein said tubular insert is concentric about said central axis and said closed end is disposed between said dense core and said integral partition.

27. The bullet of claim 26 wherein the thickness of the wall of said metal body rearward of said tubular insert is less than the thickness of said wall adjacent the closed end of said tubular insert.

28. The bullet of claim 26 wherein the radius of curvature of said closed end of said tubular insert is effective to prevent the formation of a stress point when said bullet obliquely strikes a target.

29. A bullet, comprising:

a unitary metal body having an ogival nose portion, a generally cylindrical heel portion behind said nose portion and an integral partition therebetween along a central axis therethrough, said heel portion having a rearwardly open cavity therein, a dense core filling said heel portion cavity; and a tubular metal insert of higher tensile strength than said metal body located in said rear cavity, said tubular metal insert having a closed end and an open end, the thickness of the wall of said metal body rearward of said tubular insert being less than the thickness of said wall adjacent the closed end of said tubular insert.

* * * * *